US007424987B2

(12) United States Patent
Bordignon et al.

(10) Patent No.: US 7,424,987 B2
(45) Date of Patent: Sep. 16, 2008

(54) COILING DEVICE AND METHOD FOR ROLLED OR DRAWN LONG PRODUCTS

(75) Inventors: Giuseppe Bordignon, Bicinicco (IT); Ivan Paiaro, Ronchi dei Legionari (IT); Andrea De Luca, Remanzacco (IT); Rolando Paolone, Buttrio (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 10/597,266

(22) PCT Filed: Jan. 17, 2005

(86) PCT No.: PCT/IB2005/000092

§ 371 (c)(1),
(2), (4) Date: Jul. 18, 2006

(87) PCT Pub. No.: WO2005/039793

PCT Pub. Date: May 6, 2005

(65) Prior Publication Data

US 2007/0131815 A1 Jun. 14, 2007

(30) Foreign Application Priority Data

Jan. 19, 2004 (IT) ..... UD2004A0009

(51) Int. Cl.
*B21C 47/00* (2006.01)

(52) U.S. Cl. ..... 242/574.4; 242/407.1; 72/146; 72/148

(58) Field of Classification Search ..... 242/574.4, 242/573.9, 407.1, 573, 470, 472.5, 576; 72/148, 72/146

See application file for complete search history.

(56) References Cited

U.S. PATENT DOCUMENTS 1,191,904 A * 7/1916 Luick ..... 242/574.4
1,546,628 A * 7/1925 Davis et al. ..... 242/574.4
1,827,855 A * 10/1931 Parker ..... 242/574.4
1,874,371 A * 8/1932 Sjolander ..... 242/392

(Continued)

FOREIGN PATENT DOCUMENTS

DE 11 34 950 B 8/1962

(Continued)

*Primary Examiner*—Dmitry Suhol
(74) *Attorney, Agent, or Firm*—Gottlieb, Rackman & Reisman, P.C.

(57) ABSTRACT

Coiling device (10) and relative coiling method for rolled or drawn long products, comprising a mandrel (11), arranged cantilevered and rotatable with respect to a central longitudinal axis (X), and on which the long products are wound in adjacent and superimposed spirals (33), in order to form a compact coil (31) having the geometric shape of a circular ring with lateral flanks substantially orthogonal, or very angled, with respect to the central longitudinal axis (X). The mandrel (11) comprises a flange (12) substantially orthogonal, or very angled, with respect to the central longitudinal axis (X) which defines a first lateral flank of the coil (31). The mandrel (11) also comprises first arm elements (13) which define the cylindrical surface of the core that forms the coil (31), and second arm elements (14), opposite the flange (12), which define a second flank of the coil. The first and the second arm elements (13,14) are mobile between a first coil-forming position and a second coil-removal position.

21 Claims, 2 Drawing Sheets

U.S. PATENT DOCUMENTS

| | | | | |
|---|---|---|---|---|
| 2,341,722 | A * | 2/1944 | Kelleher et al. | 242/574.4 |
| 2,529,185 | A | 11/1950 | Proctor | |
| 2,638,283 | A | 5/1953 | Bebech | |
| 3,105,653 | A | 10/1963 | Beckwith | |
| 5,409,179 | A | 4/1995 | Leclerc et al. | |

FOREIGN PATENT DOCUMENTS

| | | | |
|---|---|---|---|
| DE | 32 16 397 | A | 11/1983 |
| DE | 38 09 496 | A | 10/1989 |
| EP | 0049552 | | 4/1982 |
| EP | 1126933 | | 8/2001 |
| EP | 1 126 934 | B | 3/2003 |
| FR | 2 048 176 | A | 3/1971 |
| FR | 2 375 128 | | 7/1978 |
| JP | 06091720 | | 4/1994 |
| WO | 2004/108317 | | 12/2004 |

* cited by examiner

COILING DEVICE AND METHOD FOR ROLLED OR DRAWN LONG PRODUCTS

FIELD OF THE INVENTION

The present invention concerns a coiling device and the relative coiling method for long metal products, ferrous or not, as obtained from drawing or rolling operations, whether done hot or cold. To be more exact, the invention concerns the coiling of wire, bars, flat strips, rods (smooth or ribbed), or tubes, having a transverse section that is round, square, rectangular, hexagonal or otherwise, of various sizes.

To be more exact, the invention concerns the device to guide and contain the coiled product, on the winding mandrel, in order to contain it laterally and to impose on the forming coil the desired external form. The winding mandrel may have a horizontal, vertical or inclined axis of rotation.

The invention is applied to coiling machines with cantilevered axis.

BACKGROUND OF THE INVENTION

In the state of the art, the problems connected to coiling, on a continuously rotating mandrel, a long metal product, either rolled or drawn, traveling at high speed, to be wound in contiguous, adjacent and superimposed spirals, in a uniform manner, so as to form very compact coils, are known.

It is known that the operation to form the coil, so that the spirals are compact and uniformly distributed in every layer and for the whole longitudinal extension of the coil, is very delicate.

The problem of easily removing the finished coils from the mandrel is also known.

If the operation to remove the coil is not carried out correctly, defects may occur in the finished coils, such as for example the wound spirals may be released and/or the coiled roll may have a bad aesthetic appearance. Moreover, if the coil does not have a regular geometry, there are problems of stacking during the storage step, and also problems with installing the coil on the machine which uses the same, and problems with the correct unwinding of the coiled product.

The European patent EP-B-1.126.934 discloses a coiling machine which comprises suitable guides, substantially semi-cylindrical in shape, otherwise known as flaps or insertion blades. Said guides are able to intercept the metal product to be wound, as it arrives from the rolling mill or the drawing machine, and are able to facilitate the formation of the first spirals of the coil on the mandrel. This known coiling machine, which has the axis of the mandrel cantilevered, also comprises a mobile containing plate to frontally contain the coil, which plate cooperates with the terminal, cantilevered part of the mandrel, and which can be arranged in the following two limit positions: a first coil-forming position, wherein the containing plate is orthogonal to the axis of the mandrel and coaxial therewith, and a second position wherein the containing plate is rotated by about 90° and arranged substantially parallel to the axis of the mandrel, in a position of non-interference with the path on which the finished coil is discharged.

Before starting to distribute the spirals on the mandrel, it is necessary that the metal product to be wound is correctly gripped on the mandrel itself; to this purpose, it is necessary to provide a device that performs the attachment of the metal product to the mandrel with great reliability, precision and repeatability.

The state of the art also comprises the following documents: U.S. Pat. No. 2,529,185; U.S. Pat. No. 3,105,653; DE-A-3.216.397 and DE-A-3.809.496.

One purpose of the present invention is to achieve a coiling device for long metal products which will guarantee a considerable rapidity in installing the mobile frontal containing means that cooperate with the end part of the mandrel.

Another purpose of the invention is to guarantee the correct performance of the coiling process.

Another purpose pursued by the device according to the invention is to improve the quality of the final coil in terms of winding, compactness, density and holding capacity of the spirals.

A further purpose of the invention is to prevent damage and a reduced quality of the product.

It is also a purpose of the invention to simplify maintenance operations on said device.

The advantages achieved give a coil having a desired geometric profile which allows to exploit the storage space, also in height, to optimize the handling and transport steps, and gives a better functioning to the user machines, which can thus work at greater speed.

Applicant has devised, tested and embodied the present invention to overcome the shortcomings of the state of the art and to obtain these and other purposes and advantages.

SUMMARY OF THE INVENTION

The present invention is set forth and characterized in the main claims, while the dependent claims describe other characteristics of the present invention or variants to the main inventive idea.

In accordance with the above purposes, a coiling device for long products, whether they be rolled or drawn, according to the present invention is provided with a guide and containing device which has the characteristics as in claim 1.

The purposes are achieved also by means of a coiling method for the long metal product which has the characteristics of claim 21.

The device and method according to the present invention are applied to machines for coiling long metal products, obtained from rolling or drawing operations, whether performed hot or cold. The products can be irrespectively wire, bars, flat strips, rods (smooth or ribbed), tubes, both of ferrous material such as steels with low, medium or high carbon content, stainless steels, alloyed or other, and also non-ferrous material, such as aluminum, copper or other. The invention is applied to coiling or reeling machines which have a mandrel with a cantilevered axis.

Said long metal products can have any transverse section whatsoever, that is, round, square, rectangular, hexagonal or otherwise, particularly but not restrictively, with diameters between 8 mm and 52 mm or, in the case of bars or flat strips, with a transverse section between 60 $mm^2$ (for example 20 mm×3 mm) and 1400 $mm^2$ (for example 70 mm×20 mm).

In the following description long metal product can be taken to mean any of the above products, and also any similar or comparable products, traveling up to more than 40-45 m/sec with an hourly production of 110 tonnes and more.

According to a characteristic feature of the device according to the present invention, the mandrel comprises first arm elements, able to define the cylindrical surface of the core that forms the coil, and second arm elements able to define a flank of the coil. The first and the second arm elements are mobile between a first coil-forming position and a second coil-removal position.

In one form of embodiment, the first arm elements in their first position are substantially parallel to the central longitudinal axis of the mandrel, while in their second position they are inclined with respect to the central longitudinal axis, so as to define a substantially truncated cone surface converging towards the cantilevered end of the mandrel.

The second arm elements, in their first position, are substantially orthogonal, or very angled, with respect to the central longitudinal axis of the mandrel, while in their second position they are substantially parallel to the central longitudinal axis, and outside the space occupied by the coil formed.

In another form of embodiment, the first arm elements comprise a plurality of axial arms arranged at intervals around the central longitudinal axis, while the second arm elements comprise a plurality of containing arms arranged at intervals around the central longitudinal axis.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
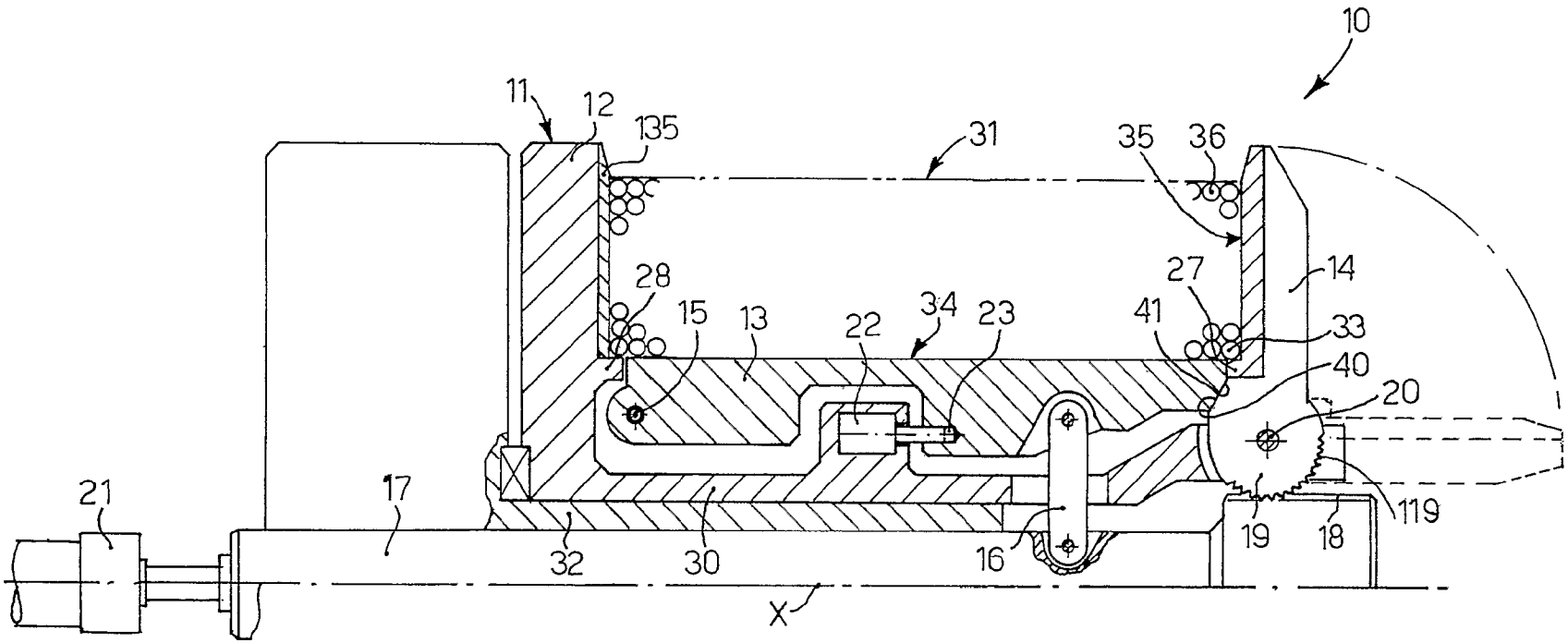
FIG. 1 is a lateral and partial view of a coiling device according to the present invention, applied to a coiling machine.

With reference to FIG. 1, a coiling device 10 according to the present invention is able to achieve a coil 31 of a long product 36, consisting for example of a metal wire with a circular transverse section.

The coiling device 10 comprises a mandrel 11 mounted rotatable and cantilevered, on a fixed cylindrical shaft 32, arranged coaxial with a longitudinal axis X. The rotation of the mandrel 11 with respect to the fixed shaft 32 is achieved in any known manner, for example by means of a drive member not shown in the drawings. Suitable known guide, positioning and drive means, and all else necessary, not shown in the drawings, are arranged between the mandrel 11 and the relative drive member.

The mandrel 11 comprises a containing flange 12, arranged perpendicular, or very angled, with respect to the longitudinal axis X. The flange 12 comprises a wall 135 which defines a lateral flank of the coil 31 to be formed. The wall 135 can be fixed, or mobile in an axial direction with respect to the mandrel 11, between a first position to start the cycle and form the first spirals of the coil 31, and a second position to form the remaining part of the same coil 31.

The flange 12 is associated stably, for example solid, with a central body 30 of the mandrel 11.

A plurality of axial arms 13 are pivoted on the central body 30, of which only one is shown in the drawings, arranged angularly off-set and substantially parallel to the axis of rotation X. To be more exact, each axial arm 13 is pivoted to the central body 30 on a pin 15.

Each axial arm 13 is able to assume a first position to form the coil 31, to allow the winding of the metal wire 36, and a second removal position, which allows to remove or extract the finished coil 31, removing it axially from the cantilevered end of the mandrel 11.

In the first position of the axial arms 13, an upper surface 34 thereof, on which the metal wire 36 rests, defines a substantially cylindrical surface of the core that forms the coil 31. In the second removal position, said upper surface 34 of each axial arm 13 defines a truncated cone figure with the smaller diameter facing towards the cantilevered end of the mandrel 11.

Moreover, on the front terminal part of the central body 30 of the mandrel 11, that is, the one in correspondence with the cantilevered end of the latter, at least two containing arms 14 are mounted, of which only one is visible in the drawings, each of which is pivoted on a pin 20.

The containing arms 14 are able to be arranged in a first position, shown in FIG. 1, wherein, with a respective wall 35, they define a lateral flank of the coil 31, opposite the one defined by the wall 135 of the flange 12 and, by means of rotation, in a second position wherein they are in a position of non-interference with respect to the axial path on which the coil 31 is removed. To this end, the position of each pin 20 is calculated so that the rotation of the corresponding containing arm 14 does not interfere with the already formed coil 31.

According to one form of embodiment, each containing arm 14 comprises an inclined wall 40 (FIGS. 1 and 2) which, in the position to form the coil 31, is in contact with a corresponding inclined edge 41 of the axial arm 13, in order to keep the latter in its first position, that is, parallel to the longitudinal axis X. In this way, the containing arms 14 contribute to contrasting the forces which develop in the coil 31 during its formation and which tend to thrust the axial arms 13 towards the longitudinal axis X.

Moreover, the containing arms 14, in their second removal position, are arranged so as to be contained inside the upper edge of the axial arms 13, when the latter are in their second position.

The flange 12, according to one embodiment, has a deposition ring 28 which extends axially and which is used to form the first rear spirals 33 of the coil 31.

The containing arms 14, according to one embodiment, have a lower tooth 27 arranged in cooperation with the wall 35 in order to support at least the inner spirals 33 of the coil 31, and facilitate the inversion of deposition of said spirals 33.

Between the central body 30 of the mandrel 11 and every axial arm 13, according to one form of embodiment, temporary clamping means are provided which, as shown in FIG. 1, comprise a jack 22 whose shaft is inserted in a clamping and positioning bushing 23. Said temporary clamping means 22 intervene only during the steps of depositing the spirals 33.

The axial arms 13 and the containing arms 14 can be driven from their first to their second position and vice versa by means of shafts, jacks, drive means, levers or other.

In one form of embodiment, shown in FIG. 1, the aforesaid drive is achieved by means of a rod 17 mounted able to slide inside the fixed central shaft 32. The rod 17 is driven for the desired travel by one or more jacks 21 anchored stably to the drive member, and can include inside itself channels that conduct cooling fluids, lubricants and/or drive fluids, or even electric cables for sensors, control means or other.

According to one form of embodiment, the rod 17 is axially holed.

In the form of embodiment shown in FIG. 1, the rod 17 is connected to a lever 16 and has rack means 18 in the front terminal part.

The lever 16 is also connected to the axial arms 13, so that the axial drive of the rod 17 determines the displacement of the respective axial arms 13 from their first position to their second position.

The rack means 18 act on a circumferential toothing 119 made in a lower zone 19 of each containing arm 14, so that the axial displacement of the rod 17 entails the rotation of the containing arms 14 between their first position and their second position.

In order to command the rod 17, instead of the jack means 21, drive means can be provided that make the rod 17 rotate, in clockwise or anti-clockwise direction. In this case, (FIG. 2), endless screw means 118 are present on the rod 17 which cooperate with corresponding circumferential toothings 119, made both on the levers 16 and also on the zones 19 of the containing arms 14. The endless screw means 118 have a suitable pitch so as to achieve the necessary rotations, even different from each other, of the levers 16 and the containing arms 14. This allows to obtain the same effect as the form of embodiment shown in FIG. 1.

Figure 3:
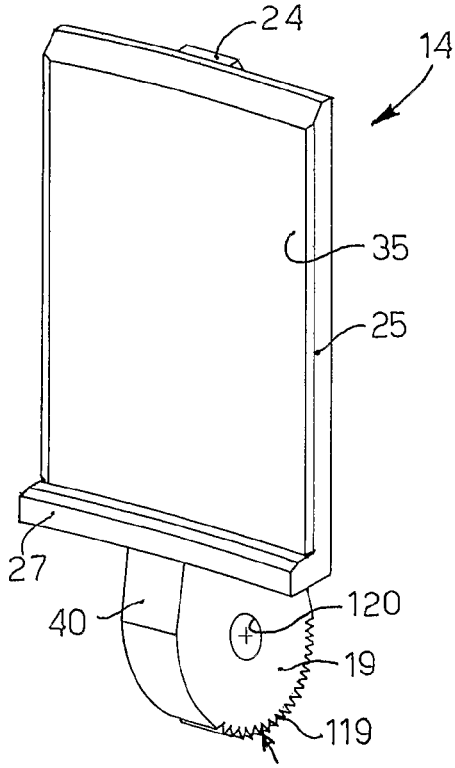
FIG. 3 shows a first variant of the device in FIG. 1.

FIG. 3 shows in detail a containing arm 14, which comprises a support 24 which ends with the zone 19, which is provided centrally with a hole 120 into which the rotation pin 20 is inserted, and a periphery 26 in which the said circumferential toothing 119 is made. The support 24 is solid with a front plate 25, which defines the wall 35 and the tooth 27, and which comprises rounded edges in order to prevent interference and impediments.

The containing arms 14 are equal or multiple in number with respect to the axial arms 13.

The lever 16 (FIG. 1), in relation to the axial arms 13, cooperates with cavity-type guide means.

Figure 2:
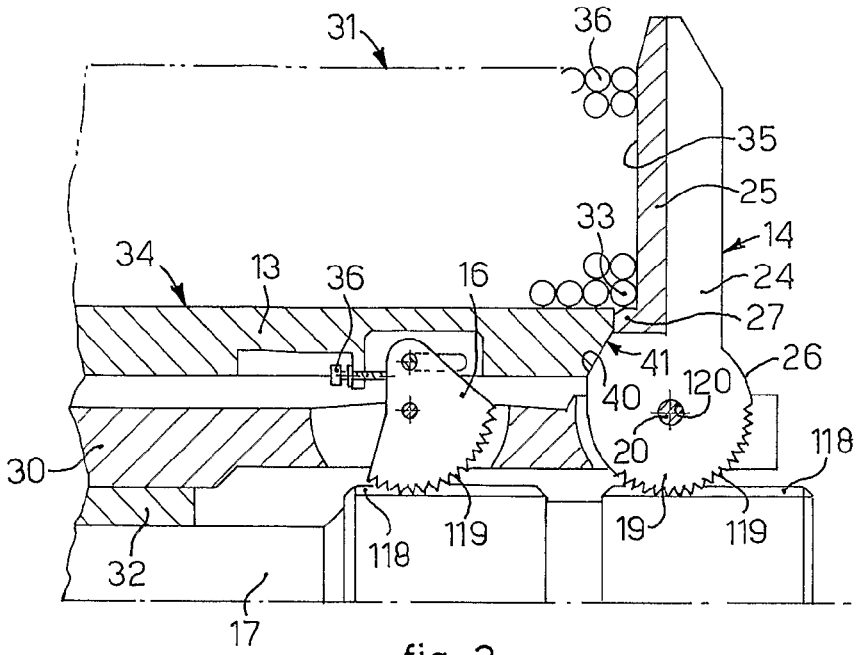
FIG. 2 is a three-dimensional view of an enlarged detail of the device in FIG. 1.

According to the embodiment shown in FIG. 2, the mandrel 11 also comprises control means 36 able to control the first position of the axial arms 13; the control means 36 consist for example of screw means which press on the lever 16.

By driving the rod 17 the containing arms 14 are made to rotate clockwise (FIG. 1) around the pin 20, until they are taken to their second position. In this second position the supporting surfaces 40 are dis-associated from the inclined edges 41 of the axial arms 13, thus allowing the latter to move to their second position.

It is clear, however, that modifications and/or additions of parts may be made to the coiling device 10 as described heretofore, without departing from the field and scope of the present invention.

It is also clear that, although the present invention has been described with reference to some specific examples, a person of skill in the art shall certainly be able to achieve many other equivalent forms of coiling device, all of which shall come within the field and scope of the present invention.

The invention claimed is:

1. Coiling device to coil rolled or drawn long products, comprising a mandrel, arranged cantilevered and rotatable with respect to a central longitudinal axis, wherein said long products are able to be wound on said mandrel in adjacent and superimposed spirals, in order to form a compact coil having the geometric shape of a circular ring with lateral flanks substantially orthogonal, or very angled, with respect to said central longitudinal axis, wherein said mandrel comprises a flange substantially orthogonal, or very angled, with respect to said central longitudinal axis and able to define a first lateral flank of said coil, wherein said mandrel also comprises first arm elements, able to define the cylindrical surface of the core that forms said coil, and second arm elements, opposite said flange, and able to define a second flank of said coil, said first and said second arm elements being movable between a first coil-forming position and a second coil-removal position, wherein said second arm elements are provided with preventing means able to contact said first arm elements, in order to prevent said first arm elements from moving from said first coil-forming position to said second coil-removal position when said second arm elements are in said first coil-forming position, and wherein said second arm elements comprise a wall, which in said first coil-forming position is parallel to said flange, and a lower tooth which extends parallel to said central longitudinal axis and is aligned with said first arm elements to cooperate with a most external spiral of a first layer of said spirals of said coil and to facilitate an inversion of deposition of said spirals.

2. Coiling device as in claim 1, characterized in that said mandrel also comprises a substantially cylindrical central body on which said first and said second arm elements are pivoted.

3. Coiling device as in claim 2, wherein first actuation means are mounted on said central body in order to command the displacement of said first arm elements between one or the other of said first and second positions.

4. Coiling device as in claim 3, wherein said first actuation means comprise levers pivoted on said central body.

5. Coiling device as in claim 2, wherein temporary positioning and clamping means, arranged on said central body, are associated with said first arm elements.

6. Coiling device as in claim 2, wherein control means, arranged on said central body, are associated with said first arm elements in order to control their first position.

7. Coiling device as in claim 2, wherein second actuation means are mounted on said central body in order to command the displacement of said second arm elements between one or the other of said first and second positions.

8. Coiling device as in claim 7, wherein first actuation means are mounted on said central body in order to command the displacement of said first arm elements between one or the other of said first and second positions, wherein said second arm elements comprise a plurality of containing arms arranged at intervals around said central longitudinal axis and wherein said second actuation means comprise toothed elements associated with said containing arms and cooperating with rack means or endless screw means.

9. Coiling device as in claim 8, wherein said first actuation means comprise levers pivoted on said central body and wherein said levers and said rack means or said endless screw means are driven by rod means.

10. Coiling device as in claim 9, wherein said rod means comprise a rod arranged coaxial with said central longitudinal axis and movable axially between two defined positions.

11. Coiling device as in claim 10, wherein said rod is hollow inside.

12. Coiling device as in claim 9, wherein said rod means comprise a rod arranged coaxial with said central longitudinal axis and able to rotate, in one direction or another, by an angle of defined amplitude.

13. Coiling method to coil rolled or drawn long products, by means of a mandrel, arranged cantilevered and rotatable with respect to a central longitudinal axis, wherein said long products are able to be wound on said mandrel in adjacent and superimposed spirals, in order to form a compact coil having the geometric shape of a circular ring with lateral flanks substantially orthogonal, or very inclined, with respect to said central longitudinal axis, wherein said mandrel comprises a flange substantially orthogonal, or very inclined, with respect to said central longitudinal axis and able to define a first lateral flank of said coil, wherein in a first step to form said coil, said mandrel has first arm elements that is provided with a first inclined wall, said first arm elements are substantially parallel to said central longitudinal axis which define in a first coil-forming position the cylindrical surface of the core that forms said coil, and second arm elements, opposite said flange, which define in a first coil-forming position a second lateral flank of said coil, wherein said second arm elements include a second inclined wall, which in said first coil-forming position is parallel to said flange, and a lower tooth which extends parallel to said central longitudinal axis and is aligned with said first elements to cooperate with a most external spiral of a first layer of said spirals of said coil and to facilitate an inversion of deposition of said spirals, wherein at the end of said first step to form said coil, said first and said second arm elements are displaced to a second position of non-interference with said coil in order to allow said coil to be removed axially from the cantilevered end of said mandrel, wherein said first and second arm elements being movable between said first coil-forming position and a second coil-removal position, wherein said second arm elements are provided with preventing means able to contact said first arm elements in order to prevent said first arm elements from moving from said first coil-forming position to said second coil-removal position when said second arm elements are in said first coil-forming position in which each one of said first arm elements that is provided with the first inclined wall is inclined with respect to said longitudinal axis and which in said first coil-forming position is in contact with the corresponding second inclined wall provided in each one of said second arm elements, and wherein said flange comprises a deposition ring cooperating with said first arm elements in order to define the cylindrical winding surface of the first layer of spirals of said coil.

14. Coiling method as in claim 13, wherein in said second position of non-interference said first arm elements are inclined with respect to said central longitudinal axis, so as to define a substantially truncated cone surface converging towards said cantilevered end of said mandrel.

15. Coiling method as in claim 13, wherein in said second position of non-interference said second arm elements are substantially parallel to said central longitudinal axis and outside the space occupied by the formed coil.

16. Coiling method as in claim 13, wherein the displacement of said first and second arm elements to said second position of non-interference with said coil is achieved by rod means arranged coaxial with said mandrel.

17. Coiling method as in claim 16, wherein the displacement of said first arm elements between one or the other of the positions to form the coil and of non-interference is achieved by first actuation means connected to said rod means.

18. Coiling method as in claim 13, wherein said second arm elements comprise a plurality of containing arms arranged at intervals around said central longitudinal axis and pivoted on a central body of said mandrel, and wherein said containing arms are pivoted on said mandrel by means of respective pins, in such a manner that during the movement of said containing arms from said first coil-forming position assumed in said first step to form the coil to said second position of non-interference, said containing arms do not interfere with said spirals of said formed coil.

19. Coiling method as in claim 13, wherein said second arm elements comprise a supporting surface able to cooperate with the most external spiral of the first layer of spirals of said coil.

20. Coiling method as in claim 13, wherein temporary positioning and clamping means, arranged on a central body of said mandrel, are associated with said first arm elements.

21. Coiling method as in claim from 13, wherein control means associated with said first arm elements control the coil-forming position of said first arm elements.

* * * * *